United States Patent [19]

Kato et al.

[11] Patent Number: 4,952,475

[45] Date of Patent: Aug. 28, 1990

[54] ELECTROPHOTOGRAPHIC PHOTORECEPTOR COMPRISING BINDER RESIN CONTAINING TERMINAL ACIDIC GROUPS

[75] Inventors: Eiichi Kato; Kazuo Ishii, both of Shizuoka, Japan

[73] Assignee: Fuji Photo Film Co., Ltd., Kanagawa, Japan

[21] Appl. No.: 308,240

[22] Filed: Feb. 9, 1989

[30] Foreign Application Priority Data

Feb. 9, 1988 [JP] Japan ..... 63-26561
Feb. 24, 1988 [JP] Japan ..... 63-39691

[51] Int. Cl.[5] ..... G03G 5/08

[52] U.S. Cl. ..... 430/96; 523/204; 430/49; 430/57; 430/58

[58] Field of Search ..... 430/96, 49; 523/204

[56] References Cited

FOREIGN PATENT DOCUMENTS 10254 1/1985 Japan .

*Primary Examiner*—J. David Welsh
*Attorney, Agent, or Firm*—Sughrue, Mion, Zinn, Macpeak & Seas

[57] ABSTRACT

An electrophotographic photoreceptor comprising a support having provided thereon at least one photoconductive layer containing at least inorganic photoconductive particles and a binder resin, is disclosed wherein said binder resin comprises (1) at least one resin (A) containing at least one acidic group selected from $-PO_3H_2$, $-SO_3H$, $-COOH$, and

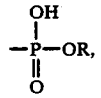

wherein R represents a hydrocarbon group, at the terminal of the polymer main chain thereof, and (2) at least one of a thermosetting resin (B) containing a crosslinking functional group and a crosslinking agent. The photoreceptor exhibits improved electrostatic characteristics. The photoreceptor provides an electrophotographic lithographic printing plate precursor which exhibits excellent image reproducibility irrespective of a variation of environmental condition at the time of electrophotographic processing and produces a printing plate having improved printing durability and causing no background stains.

12 Claims, No Drawings

ELECTROPHOTOGRAPHIC PHOTORECEPTOR COMPRISING BINDER RESIN CONTAINING TERMINAL ACIDIC GROUPS

FIELD OF THE INVENTION

This invention relates to an electrophotographic photoreceptor, and more particularly to an electrophotographic photoreceptor excellent in electrostatic characteristics and moisture resistance, and especially performance properties when used as a CPC (coated paper copy) photoreceptor.

BACKGROUND OF THE INVENTION

An electrophotographic photoreceptor may have various structures in agreement with prescribed characteristics or electrophotographic processes applied.

Widely employed among them is a system in which a photoreceptor comprised of a support having provided thereon at least one photoconductive layer and, if necessary, an insulating layer on the surface thereof. The photoreceptor comprised of a support and at least one photoconductive layer is subjected to the most general electrophotographic processing for image formation including charging, imagewise exposure, development and, if necessary, transfer.

Electrophotographic photoreceptors have also been used widely as offset printing plate precursors for direct printing plate making.

Binders to be used in the photoconductive layer should have film-forming properties by themselves, capability of dispersing photoconductive particles therein, and, when formulated into a photoconductive layer, satisfactory adhesion to a support. They are also required to bear various electrostatic characteristics and image-forming properties, such that the photoconductive layer may exhibit excellent electrostatic capacity, small dark decay and large light-decay, hardly undergo preexposure fatigue, and stably maintain these characteristics against change of humidity at the time of image formation.

Binder resins which have been conventionally used include silicone resins (see JP-B-34-6670, the term "JP-B" as used herein means an "examined published Japanese patent application"), styrene-butadiene resins (see JP-B-35-1960), alkyl resins, maleic acid resins and polyamides (see Japanese JP-B-35-11219}, vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510, and JP-B-41-13946), etc. However, electrophotographic photosensitive materials using these known resins suffer from any number of disadvantages, such as poor affinity for photoconductive particles (poor dispersion of a photoconductive coating composition); low charging properties of the photoconductive layer; poor quality of a reproduced image, particularly dot reproducibility or resolving power; susceptibility of reproduced image quality to influences from the environment at the time of electrophotogrpahic image formation, such as a high temperature and high humidity condition or a low temperature and low humidity condition; and insufficient film strength or adhesion of the photoconductive layer, which causes, when used as an offset master plate, release of the photoconductive layer from the support during offset printing, consequently failing to obtain a large number of prints.

In order to improve electrostatic characteristics of a photoconductive layer, various proposals have hitherto been made. For example, it has been proposed to incorporate into a photoconductive layer a compound containing an aromatic ring or furan ring containing a carboxyl group or nitro group either alone or in combination with a dicarboxylic acid anhydride as disclosed in JP-B 42-6878 and JP-B-45-3073. However, the thus improved photosensitive materials are still insufficient in electrostatic characteristics, particularly in light decay characteristics. The insufficient sensitivity of these photosensitive materials has been compensated by incorporating a large quantity of a sensitizing dye into the photoconductive layer. However, photosensitive materials containing a large quantity of a sensitizing dye suffer from considerable deterioration of whiteness, which means reduced quality as a recording medium, sometimes causing deterioration of dark decay characteristics, resulting in the failure to obtain a satisfactory reproduced image.

On the other hand, JP-A-60-10254 (the term "JP-A" as used herein means an "unexamined published Japanese patent application") discloses controlling the average molecular weight of the resin to be used as the binder of the photoconductive layer. According to this disclosure, the combined use of acrylic resins having an acid value of from 4 to 50 and average molecular weights distributed within two ranges, i.e., the first resin having a range of from $1\times10^3$ to $1\times10^4$ and second resin having a range of from $1\times10^4$ to $2\times10^5$, would improve electrostatic characteristics, particularly reproducibility as a PPC photoreceptor on repeated use, moisture resistance and the like.

In the field of lithographic printing plate precursors, extensive studies have been conducted to provide binder resins for a photoconductive layer having electrostatic characteristics compatible with printing characteristics. Examples of binder resins so far reported to be effective for improving oil-desensitization of a photoconductive layer include a combination of (i) a resin having a molecular weight of from $1.8\times10^4$ to $10\times10^4$ and a glass transition point of from 10° to 80° C. obtained by copolymerizing a (meth)acrylate monomer and a copolymerizable monomer in the presence of fumaric acid and (ii) a copolymer of a (meth)acrylate monomer and a copolymerizable monomer other than fumaric acid as disclosed in JP-B-50-31011; a terpolymer containing a (meth)acrylic ester unit having a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A 57-202544; a terpolymer containing a (meth)acrylic ester unit having an alkyl group having from 6 to 12 carbon atoms as a substituent and a vinyl monomer containing a carboxyl group as disclosed in JP-A-58-68046; and the like.

Nevertheless, an evaluation of the above-described resins proposed for improving electrostatic characteristics, moisture resistance and durability revealed that none of them was satisfactory for practical use in all aspects, such as charging properties, dark charge retention, photosensitivity, stability despite variations in environmental conditions such as heat and humidity, and surface smoothness of the photoconductive layer.

The binder resins proposed for use in electrophotograpahic lithographic printing plate precursors were also discovered upon evaluation to involve problems of electrostatic characteristics and background stains of prints.

SUMMARY OF THE INVENTION

One object of this invention is to provide an electrophotographic photoreceptor which exhibits improved electrostatic characteristics, particularly dark charge retention and photosensitivity, and which reproduces an image faithful to an original.

Another object of this invention is to provide an electrophotographic photoreceptor which can always form a reproduced image of high quality irrespective of variations in environmental conditions at the time of a reproduction of an image, such as a change from normal temperature and humidity to a low-temperature and low-humidity condition or a high-temperature and high-humidity condition.

A further object of this invention is to provide a lithographic printing plate precursor which exhibits excellent electrostatic characteristics, particularly dark charge retention and photosensitivity, reproduces an image faithful to an original, and produces a lithographic printing plate causing neither background stains over the entire surface of prints nor dot-like stains of prints.

It has now been found that the above objects of this invention can be accomplished by an electrophotographic photoreceptor comprising a support having provided thereon at least one photoconductive layer containing at least inorganic photoconductive particles and a binder resin, wherein said binder resin comprises (1) at least one resin (A) containing at least one acidic group selected from $-PO_3H_2$, $-SO_3H$, $-COOH$, and

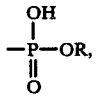

wherein R represents a hydrocarbon group, at the terminal of the polymer main chain thereof, and (2) at least one of a thermosetting resin (B) containing a crosslinking functional group and a crosslinking agent.

DETAILED DESCRIPTION OF THE INVENTION

The binder resin according to the present invention comprises at least a resin (A) containing at least one of the above-described acidic groups at the terminal of the main chain thereof and a resin (B) containing a crosslinking functional group and/or a crosslinking agent. Resin (B) is a resin which is capable of undergoing a crosslinking reaction with other functional groups in resin (A), or undergoing a self-crosslinking reaction.

In cases where resin (A) is combined with the resin (B), resin (A) has a weight average molecular weight of from $1\times10^3$ to $3\times10^4$, preferably from $3\times10^3$ to $1.5\times10^4$, and contains the acidic group(s) in a proportion of from 0.1 to 15 parts by weight per 100 parts by weight of resin (A) inclusive of the acidic group(s).

The crosslinking agent causes formation of a crosslinked structure among polymer molecules. In cases where resin (A) is combined with the crosslinking agent, resin (A) having been crosslinked by the crosslinking agent preferably has a weight average molecular weight of from $1\times10^3$ to $5\times10^5$. In these cases, the content of the acidic group(s) in resin (A) is from 0.1 to 10 parts by weight per 100 parts by weight of resin (A).

When resin (A) has a lower molecular weight of from $1\times10^3$ to $1\times10^4$, the content of the acidic group is preferably higher as ranging from 3 to 10 parts by weight per 100 parts by weight. When the resin (A) has a higher molecular weight of from $7\times10^4$ to $5\times10^5$, the content of the acidic group is preferably lower as ranging from 0.2 to 2 parts by weight per 100 parts by weight.

In the present invention, resin (A) is generally used in an amount of from about 10 to about 90 wt%, preferably from 30 to 70 wt%, based on the total resin binder.

The above-stated conventional binder resins containing acidic groups have been proposed chiefly for use as offset masters and have a high molecular weight, for example $5\times10^4$ or more, to ensure film strength retention for improving printing durability. Further, these copolymer resins are random copolymers, in which an acidic group-containing copolymerization component is present in the polymer main chain at random. To the contrary, the binder resin (A) according to the present invention contains the acidic groups at the terminal of the main chain. It was hence confirmed that the acidic group moiety at the terminal of the polymer is adsorbed onto stoichiometrical defects of the inorganic photoconductive substance to sufficiently cover the surface thereof, whereby electron traps of the photoconductive substance can be compensated, humidity resistance can be improved, and the photoconductive particles can be sufficiently dispersed without agglomeration.

When the crosslinking agent is used in combination, it is believed that the resin (A) having a relatively low molecular weight has improved covering power for the surface of the photoconductive particles and the resin (A) having a relatively high molecular weight prevents photoconductive particles from agglomeration which has been conspicuous in the case of using the conventional random copolymers. The surface smoothness of the photoconductive layer can thus be improved.

If a photoreceptor to be used as a lithographic printing plate precursor is prepared from a non-uniform dispersion of photoconductive particles in a binder resin containing agglomerates, the photoconductive layer would have a rough surface. As a result, non-image areas cannot be rendered uniformly hydrophilic by oil-desensitization treatment with an oil-desensitizing solution. Therefore, a printing plate obtained induces adhesion of a printing ink to the non-image areas on printing, which leads to background stains on the non-image areas of prints.

On the other hand, in cases where the resin (B) is used in combination, since the resin (A) has a low molecular weight, the covering power for the surface of the photoconductive substance can be improved, and the resin (B) undergoes crosslinking with the resin (A) or self-crosslinking to thereby enhance mechanical strength of the photoconductive layer that would be insufficient if the low-molecular weight resin (A) used alone.

The low-molecular weight resin (A), even when used alone, is sufficiently adsorbed on the photoconductive substance to cover the surface of the particles to provide a photoconductive layer having satisfactory smoothness and electrostatic characteristics as well as reproduced images free from background stains. Nevertheless, such a photoconductive layer is still insufficient in film strength or durability.

When a binder resin having been crosslinked with a crosslinking agent has a low molecular weight, fears have been entertained as to reduction of film strength. It was confirmed, however, that film-forming properties can be retained by sufficiently dispersing photoconductive particles in the binder so that the binder may sufficiently cover the surface of the particles through adsorption. It was further confirmed that the film strength can be improved without impairing other performance properties by using a crosslinking agent in combination to form a crosslinked structure among resin (A) of the present invention.

Accordingly, the photoreceptor of the present invention possesses excellent electrostatic characteristics irrespective of a variation of environmental conditions and a sufficient film strength as well, thereby making it possible to produce an off-set printing plate having printing durability of more than 10,000 prints.

Resin (A) having a molecular weight less than the lower limit recited above tends to have reduced film-forming properties, failing to keep sufficient film strength. On the other hand, a film formed using resin (A) having a molecular weight more than the upper limit tends to have deteriorated electrophotographic characteristics, particularly initial potential and dark decay retention. In particular, when the resin (A) having such a high molecular weight contains more than 3% by weight of the acidic group, the deterioration of electrophotographic characteristics would be serious, resulting in significant background stains when used as an offset master plate.

When the acidic group content in the resin (A) is less than the lower limit recited, the initial potential attained becomes low, failing to obtain a sufficient image density. If it exceeds the upper limit recited, dispersing properties are reduced, leading to reduction of film smoothness, reduction of humidity resistance of electrophotogrpahic characteristics, and increase of background stains on use as an offset master.

The resin (A) preferably has a glass transition point between −10° and 100° C., more preferably between −5° and 80° C.

The above-described effects, that is, proper adsorption-covering interaction between the inorganic photoconductive particles and the binder resin and retention of sufficient film strength of the photoconductive layer, can first be achieved only when the resin (A) is used in combination with the resin (B) and/or the crosslinking agent.

In the acidic group

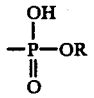

in the resin (A), the hydrocarbon group as represented by R specifically includes a substituted or unsubstituted alkyl group having from 1 to 12 carbon atoms (wherein the substituent is selected from a halogen atom such as chlorine and bromine and an alkoxy groups such as methoxy, ethoxy and butoxy), e.g., methyl, ethyl, propyl, butyl, hexyl, octyl, decyl, dodecyl, 2-chloroethyl, 2-methoxyethyl, 2-ethoxyethyl, 3-methoxypropyl; a substituted or unsubstituted aralkyl group having from 7 to 12 carbon atoms (wherein the substituent is selected from a halogen atom such as chlorine and bromine, an alkoxy group such as methoxy, ethoxy and butoxy, and an alkyl group such as methyl, ethyl and butyl), e.g., benzyl, phenethyl, chlorobenzyl, methoxybenzyl, methylbenzyl; a substituted or unsubstituted alicyclic group having from 5 to 8 carbon atoms (wherein the substituent is selected from those described for the above aralkyl group), e.g., cyclopentyl, cyclohexyl; and a substituted or unsubstituted aryl group having from 6 to 12 carbon atoms (wherein the substituent is selected from those described for the above aralkyl group), e.g., phenyl, tolyl, xylyl, mesityl, naphthyl, chlorophenyl, methoxyphenyl.

As long as the above-described physical properties are acquired, any of conventionally known resins can be used as the resin (A). Examples of resins usable as the resin (A) include polyester resins, modified epoxy resins, silicone resins, olefin copolymer resins, polycarbonate resins, vinyl alkanoate resins, allyl alkanoate resins, modified polyamide resins, phenolic resins, fatty acid-modified alkyd resins, and acrylic resins.

More specifically, the resin (A) includes (meth)acrylate copolymers containing, as a copolymerization component, at least 30% by weight of a compound represented by formula (I):

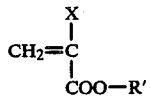

(I)

wherein X represents a hydrogen atom, a halogen atom (e.g., chlorine, bromine), a cyano group, or an alkyl group having from 1 to 4 carbon atoms; and R′ represents a substituted or unsubstituted alkyl group having from 1 to 18 carbon atoms (wherein the substituent is selected from a halogen atom such as chlorine and bromine, a cyano group, an alkoxy group such as methoxy, ethoxy and butoxy, an aryloxy group such as phenoxy, chlorophenoxy, methylphenoxy, dichlorophenoxy and bromophenoxy, —COOR″ and —OCOR″ group wherein R″ is a substituted or unsubstituted alkyl group having from 1 to 8 carbon atoms, a substituted or unsubstituted aralkyl group having from 7 to 12 carbon atoms or a substituted or unsubstituted aryl group having from 6 to 12 carbon atoms (wherein the substituent is a halogen atom, a cyano group, an alkoxy group or an aryloxy as described above)), e.g., methyl, ethyl, propyl, butyl, pentyl, hexyl, octyl, decyl, dodecyl, tridecyl, tetradecyl, 2-methoxyethyl, 2-ethoxyethyl; a substituted or unsubstituted alkenyl group having from 2 to 18 carbon atoms (wherein the substituent is selected from those described for the above alkyl group), e.g., vinyl, allyl, isopropenyl, butenyl, hexenyl, heptenyl, octenyl), a substituted or unsubstituted aralkyl group having from 7 to 12 carbon atoms (wherein the substituent is selected from those described for the above alkyl group), e.g., benzyl, phenethyl, methoxybenzyl, ethoxybenzyl, methylbenzyl), a substituted or unsubstituted cycloalkyl group having from 5 to 8 carbon atoms (wherein the substituent is selected from an alkyl group such as methyl, ethyl and butyl, and those described for the above alkyl group), e.g., cyclopentyl, cyclohexyl, and cycloheptyl; or a substituted or unsubstituted aryl group having from 6 to 12 carbon atoms (wherein the substituent is selected from an alkyl group such as methyl, ethyl and butyl, and those described for the above alkyl group), e.g., phenyl, tolyl, xylyl, mesityl, naphthyl, methoxyphenyl, ethoxyphenyl, chlorophenyl, dichlorophenyl.

In addition to the monomer of formula (I), the resin (A) may further comprise other monomers, including α-olefin,vinyl alkanoates, allyl alkanoates, acrylonitrile, methacrylonitrile, vinyl ethers, acrylamides, methacrylamides, styrene, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthioazole, vinyloxazine, etc.). Among them, vinyl acetate, allyl acetate, acrylonitrile, methacrylonitrile, and styrene are preferred from the standpoint of improvement on film strength.

In order to enhance the crosslinking effect between the resin (A) and the resin (B) and/or crosslinking agent, the resin (A) may furthermore contain a functional group crosslinkable with resin (B) and/or the crosslinking agent.

Such a functional group includes the above-recited acidic groups and, in addition, —OH, —SH, $—NH_2$, $—NHR_1$, wherein $R_1$ represents a hydrocarbon group (specific examples of the hydrocarbon group $R_1$ are the same as those described for R'),

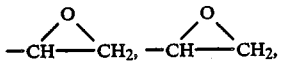

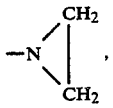

and $—CONHCH_2OR_2$, wherein $R_2$ represents a hydrogen atom, an alkyl group having from 1 to 6 carbon atoms (e.g., methyl, ethyl, propyl, butyl, hexyl), etc.

When the above-described acidic groups are contained in resin (A) as functional groups at positions other than the terminal of the main chain, these acidic group(s) preferably have a pka value higher than that of the acidic group(s) present at the terminal. More preferably, the above functional groups are those other than the above-described acidic groups.

Monomers providing a copolymer component containing such a functional group include vinyl compounds containing the functional group which are copolymerizable with the component in the resin (A), for example, the compounds of formula (I).

These vinyl compounds are described, e.g., in High Molecular Society (ed.), *Kobunshi Data Handbook* (*Kiso-hen*), Baihukan (1986). Specific examples of the vinyl compounds include acrylic acid, α- and/or β-substituted acrylic acids (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, αβ-dichloroacrylic acid), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids having the aforesaid functional group as a substituent thereof.

The proportion of the copolymer component containing the above-described functional group in the resin (A) ranges from 1 to 20 parts by weight, preferably from 3 to 10 parts by weight based on 100 parts by weight of resin (A) inclusive of the copolymer component.

The resin (A) having the acidic group at the terminal of the polymer main chain thereof cannot be obtained simply by using a copolymer component containing the acidic group, but can be obtained by bonding the acidic group to the terminal of the main chain of a copolymer comprising the above-described copolymer components. In more detail, incorporation of the acidic group to the terminal can be carried out by using a polymerization initiator containing the acidic group or a precursor thereof or a chain transfer agent containing the acidic group or a precursor thereof or a combination thereof. For example, the resin (A) can be synthesized by the processes described, e.g., P. Dreyfuss, and R. P. Quivr, *Encycl. Polym. Sci. Eng.*, Vol. 7, 551 (1987), V. Percec, *Appl. polym. Sci.*, Vol. 285, 45 (1985), P. F. Rempp. and E. Fvanta, *Adv. Polym. Sci.*, Vol. 58, 44 (1984), Y. Yamashita, *J. Appl. Polym. Sci. Appln. Polym. Symp.*, Vol. 36, 193 (1981), and R. Asami and M. Takari. *Macromol. Chem. Suppl.*, Vol. 12, 163 (1985).

The binder resin (A) thus prepared has acidic group(s) at one of the terminals of the main chain. In the present invention, the content of the acid group(s) in resin (A) is represented in terms of the amount (weight) of the polymerization initiator and/or chain transfer agent to be added.

The resin (A) may be used either individually or in combination of two or more thereof.

The resin (B) to be used in this invention is a thermosetting resin which undergoes self-crosslinking or corsslinking reaction with the resin (A) to form a crosslinked structure.

The content of a functional group in the resin (B) which participates in corsslinking preferably ranges from 1 to 20% by weight of resin (B) including the functional group. The resin (B) has a weight average molecular weight of from $1\times10^3$ to $1\times10^5$, preferably from $5\times10^3$ to $5\times10^4$.

If the crosslinking functional group in the resin (B) is less than 1% by weight of resin (B) including the functional group, the corsslinking effect would be insufficient to obtain any appreciable improvement on film strength. If it exceeds 20% by weight, gelation would occur to cause deterioration of electrophotographic characteristics and printing characteristics.

The thermosetting resin (B) is described, e.g., in T. Endo, *Netsukokasei Kobunshi no Seimitsuka*, C.M.C. (1986), Y. Harasaki, *Saishin Binder Gijutsu Binran*, Ch. II-1, Sogo Gijutsu Center (1985), T. Ohtsu, *Akuriru Jushi no Gosei Sekkei to Shin-yoto Kaihatsu*, Tyubu Keiei Kaihatsu Center Shuppan bu (1985), and E. Ohmori, *Kinosei Akuriru-kei Jushi*, Techno System (1985). Examples of the termosetting resin include polyester resins, modified or unmodified epoxy resins, polycarbonate resins, vinyl alkanoate resins, modified polyamide resins, phenolic resins, modified alkyd resins, melamine resins, and acrylic resins.

Preferably, resin (B) does not contain the specific acidic groups contained in resin (A), and, more preferably, resin (B) does not contain any of the acidic groups described for resin (A).

The resin (B), in some cases, contains a functional group capable of crosslinking with the resin (A). Included as examples of such a crosslinkable functional group are —OH, —SH, —$NH_2$, —$NHR_3$, wherein $R_3$ has the same meaning as $R_2$,

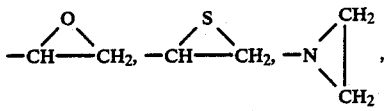

—$CONHCH_2OR_4$, wherein $R_4$ has the same meaning as $R_2$, and —NCO.

More specifically, the resin (B) includes (meth)acrylic copolymers containing the monomer unit represented by formula (I) in a proportion of at least 30% by weight. Examples of the copolymerizable monomers providing copolymer components are the same as those enumerated for the resin (A).

The content of the copolymer component containing the corsslinking functional group in the resin (B) preferably ranges from 1 to 10 mol%.

Similarly to the resin (A), the resin (B) may further contain other copolymer components than the monomers of formula (I), such as the monomers enumerated as for the resin (A).

The resin (B) may be used either individually or in combination of two or more thereof.

If desired, the binder resin according to the present invention may further comprise ,other conventional resins, such as, alkyd resins, polybutyral resins, polyolefin, ethylene-vinyl acetate copolymers, styrene resins, styrene-butadiene resins, acrylate-butadiene resins, and vinyl alkanoate resins. In the binder system comprising the resins (A) and (B), the proportion of these other resins should not exceed 30% by weight based on the total resinous components. If it exceeds 30% by weight, the effects of the present invention, especially improvement on electrostatic characteristics, are lost.

The ratio of the resin (A) to resin (B) generally ranges from 5:95 to 80:20 parts by weight, preferably from 15:85 to 60:40 parts by weight, through varying depending on the kind, particle size or surface condition of the inorganic photoconductive material used.

The crosslinking agent which can be used in combination with the resin (A) is selected from compounds commonly employed as crosslinking agents Examples of usable crosslinking agents are described, e.g., in S. Yamashita and T. Kaneko (ed.), *Kakyozai Handbook*, Taiseisha (1981) and Kobunshi Gakkai (ed.), *Kobunshi Data Handbook* (*Kiso-hen*), Baihukan (1986). Specific examples are organosilane compounds such as silane coupling agents (e.g., vinyltrimethoxysilane, vinyltributoxysilane, γ-glycidoxypropyltrimethoxysilane, γ-mercaptopropyltriethoxysilane, γ-aminopropyltriethoxysilane), polyisocyanate compounds (e.g., toluylene diisocyanate, o-toluylene diisocyanate, diphenylmethane diisocyanate, triphenylmethane triisocyanate, polymethylene polyphenyl isocyanate, hexamethylene diisocyanate, isophorone diisocyanate, high-molecular polyisocyanates), polyol compound (e.g., 1,4-butanediol, polyoxypropylene glycol, polyoxyalkylene glycols, 1,1,1-trimethylolpropane), polyamine compounds (e.g., ethylenediamine, γ-hydroxypropylated ethylenedimaine, phenylenediamine, hexamethylenediamine, N-aminoethylpiperazine, modified aliphatic polyamines), polyepoxy-containing compounds and epoxy resins [e.g., the compounds described in H. Kakiuchi (ed.), *Shin-epoxy Jushi*, Shokodo (1985), and K. Hashimoto (ed.), *Epoxy Jushi*, Nikkan Kogyo Shinbunsha (1969)[, melamine resins [e.g., the compounds described in I. Miwa and H. Matsunaka (ed.), *Urea Melamine Jushi*, Nikkan Kogyo Shinbunsha (1969)], and polymethacrylate compounds [e.g., the compounds described in S. Ohgawara, T. Saegusa, and T. Higashimura (ed.), *Oligomer*, Kodansha (1976), and E. Ohmori, *Kinosei Akuriru-kei Jushi*, Techno System (1985), e.g., polyethylene glycol diacrylate, neopentylglycol diacrylate, 1,6-hexanediol acrylate, trimethylolpropane triacrylate, pentaerythritol polyacrylate, bisphenol A diglycidyl ether diacrylate, oligoester acrylates; and the corresponding methacrylates).

The content of the crosslinking agent in the resin binder preferably ranges from 0.5 to 30% by weight, more preferably from 1 to 10% by weight.

In addition to the resin (A) and the crosslinking agent, the binder of the present invention may further comprise other resins similar to the binder comprising the resin (A) and the resin (B). In this case, the effects of the present invention can be achieved with the proportion of the resin (A) being not less than 10% by weight, preferably not less than 30% by weight. It is preferably that the other resin to be used in combination has a weight average molecular weight of $5\times10^4$ or more and does not contain an acidic group having a pKa value of 6 or smaller, e.g., —COOH, —$SO_3H$, and —$PO_3H_2$.

The binder according to the present invention comprises the resin (A) and either one or both of the resin (B) and the crosslinking agent. If desired, the binder resin may further contain a reaction accelerator, for example, an acid such as an organic acid (e.g., acetic acid, propionic acid, butyric acid).

A photosensitive coating composition comprising an inorganic photoconductive substance, e.g., zinc oxide, and the binder resin of the invention is coated on a support and then subjected to crosslinking. The crosslinking is preferably carried out by drying the photosensitive coating under severer conditions than those employed in the production of conventional photoreceptors. That is, the drying is conducted at a higher temperature and/or for a longer time, or the drying of the solvent is followed by further heating e.g., at 60 to 120° C. for 5 to 120 minutes. The drying conditions may be made milder by using the above-described reaction accelerator in combination.

The crosslinking should take place at least among the resins of the present invention, but may take place between the resins of the invention and other resins. In particular, the resin (A) is preferably crosslinked with resins having a weight average molecular weight of $2\times10^4$ or more.

The inorganic photoconductive materials which can be used in the present invention include zinc oxide, titanium oxide, zinc sulfide, cadmium sulfide, cadmium carbonate, zinc selenide, cadmium selenide, tellurium selenide, and lead sulfide, with zinc oxide and titanium oxide being preferred. The binder resin is used in an amount of from 10 to 100 parts by weight, preferably from 15 to 50 parts by weight, per 100 parts by weight of the inorganic photoconductive substance.

If desired, the photoconductive layer may further contain various dyes as spectral sensitizers, such as carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metallized phthalocyanine dyes, as described in, e.g., in H. Miyamoto and H. Takei, *Imaging*, No. 8, 12 (1973), C. J. Young, et al., *RCA Review*, Vol. 15, 469 (1954), K. Kiyota, et al., *Denki Tshushin Gakkai Ronbunshi J* 63-C., No. 2, 97 (1980), Y. Harasaki, *Kogyo Kagaku Zasshi*, Vol. 66, 78 and 188 (1963), and T. Tani, *Nippon Shashin Gakkaishi*, Vol. 35, 208 (1972).

More specifically, the carbonium dyes, triphenylmethane dyes, xanthene dyes, and phthalein dyes are described in JP-B-51-452, JP-A-50-90334, JP-A-50114227, JP-A-53-39130, and JP-A-53-82353, U.S. Pat. Nos. 3,052,540 and 4,054,450, and JP-A-57-16456. The polymethine dyes, e.g., oxonol dyes, merocyanine dyes, cyanine dyes, and rhodacyanine dyes are described in F. M. Hammer, *The Cyanine Dyes and Related Compounds*. Specific examples of these polymethine dyes are described in U.S. Pat. Nos. 3,047,384, 3,110,591, 3,121,008, 3,125,447, 3,128,179, 3,142,942, and 3,622,317, British Pat. Nos. 1,226,892, 1,309,274, and 1,405,898, and JP-B-48-7814 and JP-B-55-18892. Polymethine dyes which spectrally sensitize the near infrared to infrared regions of wavelengths longer than 700 nm are described in JP-A-47-840 and JP-A-47-44180, JP-B-51-41061, JP-A-49-5034, JP-A-49-45122, JP-A-57-46245, JP-A-56-35141, JP-A-57-15754, JP-A-61-26044, and JP-A-61-27551, U.S. Pat. Nos. 3,619,154 and 4,175,956, and *Research Disclosure*, 216, 117–118 (1982).

The photoconductive layer of the present invention is excellent in that their performance properties are not liable to variation due to sensitizing dyes used.

The photoconductive layer may furthermore contain various additives known for electrophotographic photosensitive layer, such as chemical sensitizers. Examples of the additives include electron accepting compounds (e.g., halogen, benzoquinone, chloranil, acid anhydrides, organic carboxylic acids) as described in *Imaging*, No. 8, 12 (1973), and polyarylalkane compounds, hindered phenol compounds, and p-phenylenediamine compounds as described in H. Komon, et al., *Saikin no Kododen Zairyo to Kankotai no Kaihatsu Jitsuyoka*, Chs. 4–6, Nippon Kagaku Joho, Shuppan-bu (1986). The amount of these additives is not particularly limited, but usually ranges from 0.0001 to 2.0 parts by weight per 100 parts by weight of a photoconductive substance.

The photoconductive layer is formed on a conventional support. In general, the support for an electrophotographic photosensitive layer is preferably electrically conductive. Any of conventionally employed conductive supports may be utilized in this invention. Examples of usable conductive supports include a base material (e.g., a metal sheet, paper, a plastic sheet) having been rendered electrically conductive by, for example, impregnating with a low resistant substance; a base material with its back side (i.e., the side opposite to the photosensitive layer) being rendered conductive and further coated thereon at least one layer for preventing curling, etc.; the aforesaid supports having further provided thereon a water-resistant adhesive layer; the aforesaid supports having further provided thereon at least one precoat layer; and paper laminated with a plastic film on which aluminum, etc. is deposited.

Specific examples of the conductive supports and materials for imparting conductivity are described in S. Sakamoto, *Denshishashin*, Vol. 14, No. 1, 2–11 (1975), H. Moriga, *Nyumon Tokushushi no Kagaku*, Kobunshi Kankokai (1975), and M. F. Hoover, *J. Macromol. Sci. Chem.*, A-4(6), 1327–1417 (1970).

The photoconductive layer is coated usually to a thickness of from 1 to 100 μm, preferably from 10 to 50 μm.

In cases when the present invention is applied to a laminate type photoreceptor composed of a charge generating layer and a charge transport layer, a photoconductive layer functioning as the charge generating layer, the charge generating layer suitably has a thickness of from 0.01 to 1 μm, and preferably from 0.05 to 0.5 μm.

If desired, an insulating layer can be provided on the photoconductive layer for the chief purposes of protection of the photoreceptor and for improvement of durability and dark decay characteristics. In this case, the insulating layer is coated to a relatively small thickness. For particular use in a specific electrophotographic processing, the insulating layer may be coated to a relatively large thickness. In the latter case, the insulating layer usually has a thickness of from 5 to 70 μm, preferably from 10 to 50 μm.

In the laminate photoreceptor as above referred to, materials for the charge transport layer include polyvinylcarbazole, oxazole dyes, pyrazoline dyes, and triphenylmethane dyes. The charge transport layer usually has a thickness of from 5 to 40 μm, preferably from 10 to 30 μm.

The resin which can be used for formation of the insulating layer or charge transport layer typically includes thermoplastic resins and curable resins, such as polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The present invention will now be illustrated in greater detail by way of examples, but it should be understood that the present invention is not deemed to be limited thereto. In these examples, all the ratios are by weight unless otherwise specified.

EXAMPLE 1

A mixed solution consisting of 87 g of ethyl methacrylate, 10 g of 2-hydroxyethyl methacrylate, 3 g of thioglycolic acid, and 200 g of toluene was heated to 60° C. under a nitrogen stream, and 1.0 g of azobis-(isovaleronitrile) (ABVN) was added thereto, followed by allowing to react for 4 hours. The resulting copolymer was designated as (A-1). The copolymer (A-1) had a weight average molecular weight (Mw) of 6,500 and a glass transition temperature (Tg) of 43° C.

A mixture of 40 g (as solid content) of (A-1), 200 g of zinc oxide, 0.05 g of Rose Bengale, 0.10 g of succinic anhydride, and 300 g of toluene was dispersed in a ball mill for 2 hours. To the dispersion was added 5 g of hexamethylene diisocyanate, and the mixture was further dispersed in a ball mill for 10 minutes to prepare a photosensitive coating composition.

The composition was coated on paper having been rendered electrically conductive to a dry coverage of 24 g/m$^2$ with a wire bar, followed by drying at 100° C. for 1 hour. The photosensitive layer was then allowed to stand in a dark place at 20° C. and 65% RH for 24 hours to produce an electrophotographic photoreceptor.

COMPARATIVE EXAMPLE 1

An electrophotographic photoreceptor was produced in the same manner as in Example 1, except that hexamethylene diisocyanate was not added to the zinc oxide dispersion. The resulting photoreceptor was designated as Sample A.

COMPARATIVE EXAMPLE 2

A mixed solution consisting of 87 g of ethyl methacrylate, 10 g of 2-hydroxyethyl methacrylate, 3 g of acrylic acid, and 200 g of toluene was heated to 90° C. under a nitrogen stream, and 6.0 g of ABVN was added thereto to effect reaction. The resulting copolymer (T-1) had an Mw of 7,200 and a Tg of 44° C.

An electrophotographic photoreceptor (Sample B) was produced in the same manner as in Example 1, except for using 40 g (as a solid content) of (T-1) in place of (A-1).

COMPARATIVE EXAMPLE 3

An electrophotographic photoreceptor (Sample C) was produced in the same manner as in Comparative Example 1, except for using (T-1) in place of (A-1).

Each of the photoreceptors obtained in Example 1 and Comparative Examples 1 to 3 were evaluated for film properties in terms of surface smoothness, electrostatic characteristics, oil-desensitization of the photoconductive layer in terms of contact angle with water after oil-desensitization, and printing performances in terms of stain resistance in accordance with the following test methods.

(1) Smoothness of Photoconductive Layer:

The smoothness (sec/cc) was measured by means of a Beck smoothness tester manufactured by Kumagaya Riko K.K. under a condition of an air volume of 1 cc.

(2) Electrostatic Characteristics:

The sample was charged by corona discharge to a voltage of 6 kV for 20 seconds in a dark room at 20° C. and 65% RH using a paper analyzer ("Paper Analyzer SP-428" manufactured by Kawaguchi Denki K.K.). After the sample was allowed to stand for 10 seconds, the surface potential $V_{10}$ was measured. Then, the photoreceptor was further allowed to stand in the same dark room for an additional period of 60 seconds, and the potential $V_{70}$ was measured. The potential retention, i.e., DRR (%), after the 60 seconds' dark decay was calculated from $(V_{70}V_{10})\times 100$ (%).

Further, the surface of the photoconductive layer was charged to −400 V by corona discharge and then irradiated with visible light at an illumination of 2.0 lux, and the time required to reduce the surface potential $V_{10}$ to one-tenth was measured. The exposure amount $E_{1/10}$ (lux.sec) was then calculated therefrom.

(3) Image Quality:

The sample was allowed to stand under an ambient condition of 20° C., 65% RH (hereinafter referred to as Environmental Condition I) or a high-temperature and high-humidity condition of 30° C. and 80% RH (hereinafter referred to as Environmental Condition II) for 24 hours and then processed using an automatic camera processor "ELP-404V" (manufactured by Fuji Photo Film Co., Ltd.). The image reproduced on the resulting printing plate was visually evaluated for fog and image quality.

(4) Contact Angle With Water:

The sample was passed once through an etching processor using an oil-desensitizing solution ("ELP-E" produced by Fuji Photo Film Co., Ltd.) to oil-desensitize the surface of the photoconductive layer. On the thus oil-desensitized surface was placed a drop of 2 μl of distilled water, and the contact angle formed between the surface and water was measured by a goniometer.

(5) Background Stain:

The sample was exposed to light and developed with a developer ("ELP-E" produced by Fuji Photo Film Co., Ltd.) by means of an automatic camera processor "ELP-404V" to form a toner image, and the surface of the photoconductive layer was subjected to oil-desensitization under the same conditions as in (4) above. The resulting printing plate was mounted on an offset printing machine "Hamada Star 800SX" (manufactured by Hamada Star K.K.), and printing was carried out on fine paper in a usual manner (hereinafter referred to as Printing Condition I) to obtain 500 prints. All the resulting prints were visually evaluated for background stains.

The same evaluation was repeated, except that the printing was carried out under severer conditions, i.e., by using a 5-fold diluted oil-desensitizing solution and a 2-fold diluted dampening water for printing (hereinafter referred to as Printing Condition II).

(6) Printing Durability:

The sample was processed under the same conditions as Condition I in (5) above, and printing was carried out under Printing Condition I as used in (5) above. The number of prints obtained until background stains of the non-image areas was observed or quality of image areas was deteriorated was taken as printing durability. The more the number, the higher the printing durability.

The results of these evaluations are shown in Table 1 below.

TABLE 1

| | Example 1 | Compar. Example 1 | Compar. Example 2 | Compar. Example 3 |
|---|---|---|---|---|
| Smoothness of Photoconductive Layer (sec/cc) | 83 | 86 | 86 | 80 |
| Electrostatic Characteristics: | | | | |
| $V_{10}$ (−V) | 555 | 560 | 550 | 540 |
| DRR (%) | 93 | 96 | 84 | 82 |
| $E_{1/10}$ (lux · sec) | 4.2 | 3.5 | 9.1 | 9.6 |
| Quality of Reproduced Image: | | | | |
| Condition I | good | good | good | good |
| Condition II | good | good | good | good |
| Contact Angle With Water (degree) | 11 | 10 | 12 | 13 |
| Background Stain: | | | | |
| Condition I | excellent | excellent | excellent | excellent |
| Condition II | good | good | good | good |
| Printing Durability | 7,500 | 3,500 | 3,000 | 7,500 |

As is apparent from Table 1, the sample of the present invention (Example 1) and Sample A (Comparative Example 1) have a smooth photoconductive layer and exhibit satisfactory electrostatic characteristics, and the printing plates produced therefrom provide a clear reproduced image free from background stains. To the contrary, Samples B and C. (Comparative Examples 2 and 3) had reduced photosensitivity as compared with the sample of the present invention, and therefore the printing plates produced therefrom exhibit poor reproducibility in reproduction of fine line images or low density images or originals involving background stains.

All the printing plate precursors shown a contact angle with water as small as 15° or less, indicating that the surface of the photoconductive layer was rendered sufficiently hydrophilic by the oil-desensitization. On printing, no background stains of prints was observed at all.

When a large number of prints were printed, the master plates obtained from the sample of the invention and Sample C. caused appreciable background stain from the 7,500th print, while those of Samples A and B caused background stains or disappearance of letters or fine lines beginning with the 3,000th to 3,500th print.

From these facts, it is proved that only the binder resin according to the present invention can provide an electrophotographic photoreceptor having satisfactory electrostatic characteristics and printing performance.

EXAMPLES 2 TO 6

A mixed solution consisting of 85 g of benzyl methacrylate, 12 g of 2-hydroxyethyl methacrylate, 3 g of thiomalic acid, 150 g of tetrahydrofuran, and 50 g of methyl alcohol was heated to 60° C. in a nitrogen stream. To the mixture was added 1.0 g of ABVN, and the mixture was allowed to react for 4 hours. After adding 0.5 g of ABVN, the reaction was continued for an additional period of 4 hours. After cooling, the reaction mixture was poured into 2 l of a 3:1 (by volume) mixture of methanol and water, and the viscous substance thus precipitated was collected by decantation to obtain 72 g of a copolymer (A-2) having a Mw of 6,100 and a Tg of 28° C.

Copolymers (A-3) to (A-6) were synthesized in the same manner as for (A-2), except for replacing thiomalic acid with 3 g each of the compounds shown in Table 2 below.

TABLE 2

| Example No. | Resin No. | Mercapto Compound | Mw | Tg |
|---|---|---|---|---|
| 2 | A-2 | $HS-CH(CH_2-COOH)-COOH$ | 6,100 | 31° C. |
| 3 | A-3 | 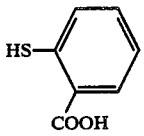 | 6,500 | 30° C. |
| 4 | A-4 | $HSCH_2CH_2SO_3H$ | 6,600 | 30° C. |
| 5 | A-5 | $HS(CH_2)_3O-P(=O)(OH)-OH$ | 5,900 | 30° C. |
| 6 | A-6 | $HS(CH_2)_2O-P(=O)(OC_2H_5)-OH$ | 6,300 | 30° C. |

A mixture of 40 g (as solid content) of each of the copolymers (A-2) to (A-6), 200 g of zinc oxide, 0.006 g of Tetrabromophenol Blue, 0.10 g of phthalic anhydride, and 300 g of toluene was dispersed in a ball mill for 2 hours. To the dispersion was added 5 g of 1,4-tetramethylene diisocyanate, and the mixture was further dispersed in a ball mill for 10 minutes to prepare a photosensitive coating composition.

Electrophotographic photoreceptors were produced in the same manner as in Example 1, except for using the above-prepared coating compositions.

Upon evaluation, each sample exhibited excellent charging properties, dark decay retention, and photosensitivity, and the printing plate produced therefrom reproduced a clear image free from background stains or diappearance of fine lines even when processed under severe conditions (30° C., 80% RH). When the master plate was used for printing, from 6,000 to 7,000 prints were obtained with clear image and free from background fog.

EXAMPLE 7

A mixed solution of 35 g of ethyl methacrylate, 45 g of benzyl methacrylate, 15 g of a monomer of formula:

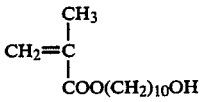

150 g of toluene, and 50 g of isopropyl alcohol was heated at 75° C. in a nitrogen stream, and 5 g of 2,2'-azobis(4-cyanovaleric acid) was added thereto, to effect reaction for 8 hours. After cooling, the reaction mixture was poured into 2 of a mixed solvent of methanol and water (4:1 by volume), and the viscous substance thus precipitated was collected and dried to obtain 72 g of a copolymer (A-7) having an Mw of 7,400 and a Tg of 22° C.

A mixture of 40 g (as solid content) of the copolymer (A-7), 200 g of zinc oxide, 0.02 g of a heptamethinecyanine dye of formula:

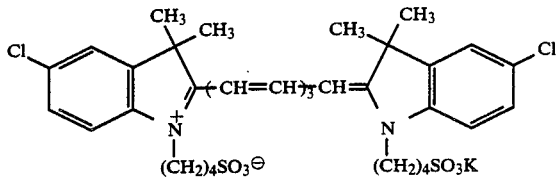

0.15 g of phthalic anhydride, and 300 g of toluene was dispersed in a ball mill for 2 hours. To the dispersion was added 6 g of 1,6-hexamethylene diisocyanate, and the mixture was further dispersed in a ball mill for 5 minutes to prepare a photosensitive coating composition.

An electrophotographic photoreceptor was produced in the same manner as in Example 1, except for using the above-prepared composition.

COMPARATIVE EXAMPLE 4

A mixed solution of 35 g of ethyl methacrylate, 45 g of benzyl methacrylate, 15 g of the same monomer as used in Example 7, 5 g of acrylic acid, and 200 g of toluene was heated at 90° C. in a nitrogen stream. To the mixture was added 5.0 g of ABVN, and the mixture was allowed to react for 8 hours. The resulting copolymer (T-3) had a Mw of 8,300 and a Tg of 24° C.

An electrophotographic photoreceptor (Sample D)was produced in the same manner as in Example 7, except for replacing (A-7) with 40 g (as solid content) of (T-3).

Each of the samples of Example 7 and Sample D was evaluated for surface smoothness and electrostatic characteristics in the same manner as in Example 1, except for using a gallium-aluminum-arsenic semiconductor laser (oscillation wavelength: 780 nm) as a light source. The results obtained are shown in Table 3 below.

TABLE 3

| | Example 7 | Compar. Example 4 |
|---|---|---|
| Smoothness of Photoconductive Layer (sec/cc) | 82 | 83 |
| Electrostatic Characteristics: | | |
| $V_{10}$ (−V) | 565 | 550 |
| DRR (%) | 93 | 51 |
| $E_{1/10}$ (lux · sec) | 55 | 49 |

Sample D exhibit poor surface smoothness and considerably reduced dark charge retention (DRR). The seemingly small $E_{1/10}$ of Sample D. indicative of high photosensitivity, is ascribed to the reduced DRR. the DRR of Sample D shows further inferiority to Sample A. This means that the conventionally known resin is very susceptible to influences of the kind of spectral sensitizing dyes used. To the contrary, the binder resin of the present invention always provides a photoreceptor excellent in charging properties, dark decay retention, and photosensitivity irrespective of a chemical structure of the spectral sensitizing dye used.

EXAMPLES 8 TO 12

An electrophotographic photoreceptor was produced in the same manner as in Example 1, except for replacing hexamethylene diisocyanate as used in Example 1 with each of the crosslinking agents shown in Table 4 below.

TABLE 4

| Example No. | Crosslinking Agent |
|---|---|
| 8 | ethylene glycol diglycidyl ether |
| 9 | Eponit 012 (tradename, produced by Nitto Kasei K. K.) |
| 10 | Rika Resin PO-24 (tradename, produced by New Japan Chemical Co., Ltd.) |
| 11 | diphenylmethane diisocyanate |
| 12 | triphenylmethane triisocyanate |

Each of the resulting photoreceptors was processed in the same manner as in Example 1 and then etched. The master plate for offset printing as obtained by processing had a clear reproduced image having a density of 1.0 or more. When printing was carried out using the resulting printing plate, more than 7,000 prints having a clear image free from background fog were obtained.

EXAMPLE 13

A mixed solution 95 g of ethyl acrylate and 200 g of toluene was heated to 90° C. under a nitrogen stream, and 5 g of 4,4'-azobis(4-cyanovaleric acid) (ABCV) was added thereto, followed by allowing to react for 10 hours. The resulting copolymer (A-8) had an Mw of 8,300 and a Tg of 46° C.

Separately, a mixed solution of 95 g of ethyl methacrylate, 5 g of glycidyl methacrylate, and 200 g of toluene was heated 75° C. under a nitrogen stream. One gram of azobisisobutyronitrile was added thereto to effect reaction for 8 hours. THe resulting polymer, designated as (B1), had an Mw of 43,000 and a Tg of −5° C.

A mixture of 30 g (as solid content) of (A-8), 10 g (as solid content) of (B-1), 200 g of zinc oxide, 0.05 g of Rose Bengale, and 300 g of toluene was dispersed in a ball mill for 2 hours to prepare a photosensitive coating composition.

The composition was coated on paper having been rendered conductive to a dry coverage of 22 g/m$^2$ with a wire bar, followed by drying at 100° C. for 30 minutes. The photosensitive layer was then allowed to stand in a dark place at 20° C. and 65% RH for 25 hours to produce an electrophotographic photoreceptor.

EXAMPLE 14

A mixed solution 95 g of n-butyl methacrylate, 5 g of iminol methacrylate, and 200 g of toluene was heated to 75° C. in a nitrogen stream, and 1.0 g of azobisisobutyronitrile was added thereto to effect reaction for 8 hours. The resulting copolymer (B-2) had an Mw of 45,000 and a Tg of 0° C.

A photoreceptor was produced in the same manner as in Example 13, except for using (B-2) in place of (B-1).

COMPARATIVE EXAMPLE 5

A photoreceptor (Sample E) was produced in the same manner as in Example 13, except for using 40 g (as solid content) of (A-8) in place of (A-8) and (B-1).

Each of the samples of Examples 13 and 14 and Sample E was evaluated in the same manner as in Example 1. In addition, each sample was evaluated for mechanical strength of the photoconductive layer according to the following test method. The results obtained are shown in Table 5 below.

(7) Mechanical Strength of Photoconductive Layer:

The surface of the photoreceptor was rubbed 1,000 times with emery paper (#1000) under a load of 50 g/cm$^2$ by means of a Heidon-14 type surface tester (manufactured by Shin-to Kagaku K.K.). After removing any powder on the surface, the weight loss of the photoconductive layer on abrasion was measured to obtain a film retention (%).

TABLE 5

| | Example 13 | Example 14 | Compar. Example 5 |
|---|---|---|---|
| Smoothness of Photoconductive Layer (sec/cc) | 95 | 98 | 80 |
| Strength of Photoconductive Layer (%) | 96 | 97 | 60 |
| Electrostatic Characteristics: | | | |
| $V_{10}$ (−V) | 575 | 570 | 600 |
| DRR (%) | 94 | 91 | 94 |
| $E_{1/10}$ (lux · sec) | 3.6 | 3.4 | 8.5 |
| Quality of Reproduced Image: | | | |
| Condition I | good | good | good |
| Condition II | good | good | good |
| Contact Angle With Water | 12 | 13 | 13 |
| Background Stains: | | | |
| Condition I | excellent | excellent | excellent |
| Condition II | good | good | good |
| Printing Durability | more than 10,000 prints | more than 10,000 prints | 3,000 prints |

As is apparent from Table 5, the samples of the present invention and Sample E exhibit satisfactory surface smoothness and electrostatic characteristics and provide a clear reproduced image free from background fog. These result are assumed to be attributed to sufficient adsorption of the binder resin onto the photoconductive particles to cover the surface of the particles.

For the same reason, when each of the photoreceptors was used as a precursor of an offset master plate, oil-desensitization with an oil-desensitizing solution sufficiently proceeds. Contact angles of the non-image area with water as small as 15° or less indicated that the non-image area had been made sufficiently hydrophilic. On printing, no background stains were observed at all. However, Sample E showed greatly deteriorated printing durability due to its insufficient film strength.

Sample E had reduced photosensitivity as compared with the samples of the present invention. It suffers from, therefore, a problem of reproduction when used for reproduction of an original of fine line image, an original of low density.

Any of the samples according to the present invention was proved excellent in charging properties, dark decay retention, and photosensitivity, and capable of providing a clear reproduced image free from background fog or disappearance of fine lines even when processed under severe conditions of high temperature and high humidity (30° C., 80% RH).

EXAMPLE 15

A mixed solution of 95 g of ethyl methacrylate, 5 g of thioglycolic acid, and 200 g of toluene was heated to 75° C. in a nitrogen stream, and 1.0 g of azobisisobutyronitrile was added thereto, followed by reacting for 8 hours. The resulting resin (A-9) had a Mw of 7,800 and a Tg of 40° C.

An electrophotographic photoreceptor was produced in the same manner as in Example 13, except for using 30 g (as solid content) of (A-9) in place of (A-8).

The resulting photoreceptor was evaluated in the same manner as in Example 13. As a result, the photoconductive layer had a smoothness of 80 sec/cc; the photoreceptor had excellent electrostatic characteristics as having a $V_{10}$ of −550 V, a DRR of 90%, and an $E_{1/10}$ of 3.6 lux. sec; and formed a satisfactory reproduced image under the condition of 30° C. and 80%RH.

EXAMPLE 16

A mixed solution of 92 g of ethyl methacrylate, 5 g of 2-hydroxyethyl methacrylate, and 200 g of toluene was heated to 85° C. in a nitrogen stream, and a 3 g of ABCV was added thereto, followed by allowing the mixture to react for 20 hours. The resulting copolymer resin (A-10) had an Mw of 8,200 and a Tg of 43° C.

An electrophotographic photoreceptor was produced in the same manner as in Example 13, except for replacing 30 g of (A-8) and 10 g of (B-1) with 25 g of (A-10) and 15 g of (B-1).

COMPARATIVE EXAMPLE 6

A mixed solution of 99 g of ethyl methacrylate, 1 g of acrylic acid, and 200 g of toluene was heated to 75° C. in a nitrogen stream, and 1 g of azobisisobutyronitrile was added thereto, followed by allowing the mixture to react for 20 hours. The resulting copolymer resin (T-4) had a Mw of 45,000 and a Tg of 45° C.

An electrophotographic photoreceptor (Sample F) was produced in the same manner as in Example 13, except for replacing 40 g of (A-8) and (B-1) with 40 of (T-4).

Each of the photoreceptor of Example 16 and Comparative Example 6 was evaluated for electrostatic characteristics and image quality in the same manner as in Example 1. Further, the photoreceptor was electrophotographically processed, and printing was carried out. The results obtained are shown in Table 6.

TABLE 6

| | Example 16 | Compar. Example 6 |
|---|---|---|
| Resin Used | (A − 10) + (B − 1) | (T − 4) |
| Electrostatic Characteristics: | | |
| $V_{10}$ (−V) | 550 | 550 |
| DRR (%) | 88 | 83 |
| $E_{1/10}$ (lux · sec) | 4.0 | 10.5 |
| Image Quality (30° C., 80% RH) | good | poor (no DM appeared; cut of fine lines occurred) |
| Printing Durability | more than 10,000 prints | cut of fine lines of letters occurred from the start of printing |

Sample F using the conventional random copolymer resin (T-4) had reduced surface smoothness. Although Sample F exhibit satisfactory electrostatic characteristics under an ambient temperature and ambient humidity condition, it had reduced photosensitivity. Further a reproduced image obtained by using Sample F had a deteriorated image when processed under a severe condition (30° C., 80% RH). When the offset master plate obtained from Sample F naturally caused cut of fine lines or letters of image areas.

The sample of the present invention has satisfactory surface smoothness and excellent electrostatic characteristics (dark decay retention, photosensitivity) and provides a clear reproduced image free from background stains or disappearance of fine lines even when processed under a high temperature and high humidity condition. When the offset master plate produced from the sample of the invention was used for printing, a large number of prints were obtained.

It is hence believed that the position of the acidic group in the binder resin greatly influences the state of dispersion of the zinc oxide particles and that the binder resin according to the present invention enables the particles be dispersed in a desirable state.

EXAMPLE 17 TO 21

Copolymer resins (A-11) to (A-15) were synthesized in the same manner as in Example 15, except for replacing thioglycolic acid as used in Example 15 with each of the chain transfer agents shown in Table 7 below.

TABLE 7

| Example No. | Resin No. | Chain Transfer Agent | Mw |
|---|---|---|---|
| 17 | A-11 | $HS(CH_2)_2—COOH$ | 8,300 |
| 18 | A-12 | $HS—\underset{\underset{CH_2—COOH}{\vert}}{CH}—COOH$ | 7,600 |

TABLE 7-continued

| Example No. | Resin No. | Chain Transfer Agent | Mw |
|---|---|---|---|
| 19 | A-13 | 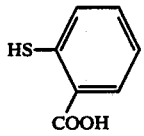 | 7,700 |
| 20 | A-14 | $HSCH_2CH_2SO_3H$ | 7,600 |
| 21 | A-15 | $HS(CH_2)_3O-\overset{\overset{O}{\|}}{\underset{\underset{OH}{\|}}{P}}-OH$ | 7,800 |

An electrophotographic photoreceptor was produced in the same manner as in Example 15, except for using each of the resins (A-11) to (A-15) in place of (A-9).

When the resulting photoreceptors were evaluated in the same manner as in Example 15, any of them exhibited excellent performance characteristics.

EXAMPLES 22 TO 23

An electrophotographic photoreceptor was produced in the same manner as in Example 13, except for replacing (1-8) and (B-1) as used in Example 13 with (A-10) and each of the resins (B) shown in Table 8 at a weight ratio of 3/2.

TABLE 8

| Example No. | Resin (B) | Structure of Resin (B) (Copolymerization ratio: by weight) | Mw |
|---|---|---|---|
| 22 | B-3 | 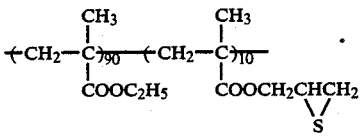 | 46,000 |
| 23 | B-4 | 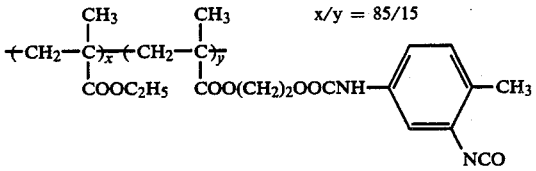 x/y = 85/15 | 35,000 |

Each of the resulting samples was evaluated in the same manner as in example 13. As a result, any of the samples was excellent in charging properties, dark decay retention, and photosensitivity and provided a clear reproduced image free from background stains even when processed under a severe condition of a high temperature and a high humidity (30° C., 80% RH).

When an offset master plate produced from each of the samples was used for printing, more than 10,000 prints having a clear image were obtained.

EXAMPLE 24

A mixed solution of 48.5 g of ethyl methacrylate, 48.5 g of benzyl methacrylate, 1.5 g of thioglycolic acid, and 200 g of toluene was heated to 90° C. in a nitrogen stream, and 1.5 g of ABCV was added thereto, followed by allowing the mixture to react for 10 hours. The resulting copolymer (A-16) had an Mw of 6,500 and a Tg of 40° C.

A mixture of 20 g (as solid content) of (A-16), 20 g of (B-1) as used in Example 13,200 g of zinc oxide, 0.02 g of a heptamethinecyanine dye of formula:

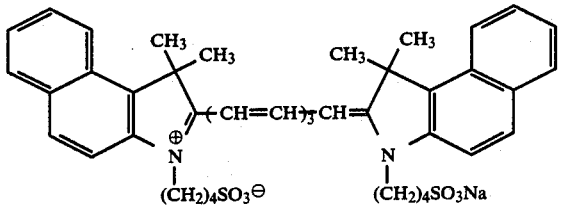

0.015 g of phthalic anhydride, and 300 g of toluene was dispersed in a ball mill for 2 hours to prepare a photosensitive coating composition.

An electrophotographic photoreceptor was produced in the same manner as in Example 13, except for using the above-prepared coating composition and the drying condition was changed to 80° C. for 1 hours.

COMPARATIVE EXAMPLE 7

A mixed solution of 48.5 g of ethyl methacrylate, 48.5 g of benzyl methacrylate, 3 g of methacrylic acid, and 200 g of toluene was heated to 70° C. in a nitrogen stream, and 1.0 g of azobisisobutyronitrile was added thereto, followed by allowing to react for 8 hours. The resulting copolymer (T-5) had an Mw of 36,000 and a Tg of 54° C.

A photoreceptor was produced (Sample G) in the same manner as in Example 24, except for replacing (A-16) and (B-1) as used in Example 24 with 40 g (as solid content) of (T-5).

Each of the samples of Example 24 and Sample G was evaluated for electrostatic characteristics in the same manner as in Example 13, except for using a gallium-aluminum-arsenic semiconductor laser (oscillation wavelength: 830 nm) as a light source. The results obtained are shown in Table 9.

TABLE 9

| | Example 24 | Compar. Example 7 |
|---|---|---|
| Smoothness of Photoconductive Layer (sec/cc) | 98 | 14 |
| Strength of Photoconductive Layer (%) | 98 | 89 |
| Electrostatic Characteristics: | | |

TABLE 9-continued

| | Example 24 | Compar. Example 7 |
|---|---|---|
| $V_{10}$ (−V) | 560 | 510 |
| DRR (%) | 93 | 50 |
| $E_{1/10}$ (lux · sec) | 34 | 50 |

Sample G has poor surface smoothness and considerably reduced dark charge retention (DRR). The seemingly low $E_{1/10}$ of Sample G, indicative of higher photosensitivity, is attributed to the low DRR. Sample G is further inferior to Sample F in DRR. This means that the conventional resin is susceptible to influences of the kind of spectral sensitizing dyes used in combination. To the contrary, the binder resin of the present invention always produces a photoreceptor excellent in both charging properties and Dark charge retention as well as photosensitivity irrespective of the chemical structure of the spectral sensitizer used.

As described above, the present invention provides an electrophotographic photoreceptor exhibiting excellent performance properties, such as surface smoothness and strength of a photoconductive layer, electrostatic characteristics, and image forming properties. When the electrophotographic photoreceptor of the present invention is used as a precursor for an offset master plate, the resulting printing plate exhibits excellent performance properties, such as resistance to background stains and printing durability.

In addition, the excellent surface smoothness of the photoconductive layer and electrostatic characteristics of the electrophotographic photoreceptor of the present invention are retained even when combined with any kind of spectral sensitizing dyes.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having provided thereon at least one photoconductive layer containing at least inorganic photoconductive particles and a binder resin, wherein said binder resin comprises (1) at least one resin (A) containing at least one acidic group selected from $-PO_3H_2$, $-SO_3H$, $-COOH$, and

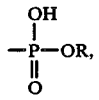

wherein R represents a hydrocarbon group, at the terminal of the polymer main chain thereof, and (2) at least one of a thermosetting resin (B) containing a crosslinking functional group and a crosslinking agent.

2. An electrophotographic photoreceptor as in claim 1, wherein resin (A) is combined with resin (B), the binder comprises at least 70 parts by weight of resin (A) and (B) based on the total resinous component, resin (A) has a weight average molecular weight of from $1\times10^3$ to $3\times10^4$, and resin (A) contains said acidic group(s) in a proportion of from 0.1 to 15 parts by weight per 100 parts by weight of resin (A) inclusive of the acidic group(s).

3. An electrophotographic photoreceptor as in claim 2, wherein resin (B) does not contain the same acidic group(s) present in resin (A).

4. An electrophotographic photoreceptor as in claim 2, wherein the weight ratio of resin (A) to resin (B) ranges from 5:95 to 80:20 parts by weight.

5. An electrophotographic photoreceptor as in claim 1, wherein resin (A) is combined with the crosslinking agent, resin (A) comprises at least 10 parts by weight of the resinous component of the binder, resin (A) having been crosslinked by the crosslinking agent has a weight average molecular weight of from $1\times10^3$ to $5\times10^5$, and the content of the acidic group(s) in resin (A) is from 0.1 to 10 parts by weight per 100 parts by weight of resin (A).

6. An electrophotographic photoreceptor as in claim 1, wherein resin (A) has a glass transition point between −10° C. and 100° C.

7. An electrophotographic photoreceptor as in claim 1, wherein the hydrocarbon group represented by R is selected from the group consisting of a substituted or unsubstituted alkyl group having from 1 to 12 carbon atoms, a substituted or unsubstituted aralkyl group having from 7 to 12 carbon atoms, a substituted or unsubstituted alicyclic group having from 5 to 8 carbon atoms, and a substituted or unsubstituted aryl group having from 6 to 12 carbon atoms.

8. An electrophotographic photoreceptor as in claim 1, wherein resin (A) is selected from the group consisting of polyester resins, modified epoxy resins, silicone resins, olefin copolymer resins, polycarbonate resins, vinyl alkanoate resins, allyl alkanoate resins, modified polyamide resins, phenolic resins, fatty acid-modified alkyd resins, and acrylic resins.

9. An electrophotographic photoreceptor as in claim 1, wherein resin (A) is a (meth)acrylate copolymer containing, as a copolymerization component, at least 30% by weight of a compound represented by formula (I):

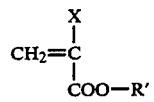

(I)

wherein X represents a hydrogen atom, a halogen atom, cyano group, or an alkyl group having from 1 to 4 carbon atoms; and R′ represents a substituted or unsubstituted alkyl group having from 1 to 18 carbon atoms, a substituted or unsubstituted alkenyl group having from 2 to 18 carbon atoms, a substituted or unsubstituted aralkyl group having from 7 to 12 carbon atoms, a substituted or unsubstituted cycloalkyl group having from 5 to 8 carbon atoms, or substituted or unsubstituted aryl group having from 6 to 12 carbon atoms.

10. An electrophotographic photoreceptor as in claim 1, wherein resin (B) has a weight average molecular weight of from $1\times10^3$ to $1\times10^5$.

11. An electrophotographic photoreceptor as in claim 1, wherein said binder resin comprises (1) said at least one resin (A) and (2) said crosslinking agent.

12. An electrophotographic photoreceptor as in claim 11, wherein said crosslinking agent is present in the binder resin in an amount of from 0.5 to 30% by weight.

* * * * *